US007757306B2

(12) United States Patent
Mattioli

(10) Patent No.: US 7,757,306 B2
(45) Date of Patent: Jul. 20, 2010

(54) NECKTIE WITH THREE OR MORE PARTS IN SIGHT AND KNOT WITH TWO OR MORE FABRIC FILMS

(76) Inventor: Alessandro Mattioli, Via Dante, 16, Zola Predosa-Bologna (IT) 40069

( * ) Notice: Subject to any disclaimer, the term of this patent is extended or adjusted under 35 U.S.C. 154(b) by 1367 days.

(21) Appl. No.: 10/527,194

(22) PCT Filed: Feb. 10, 2003

(86) PCT No.: PCT/IT03/00061

§ 371 (c)(1),
(2), (4) Date: Aug. 11, 2004

(87) PCT Pub. No.: WO03/065830

PCT Pub. Date: Aug. 14, 2003

(65) Prior Publication Data

US 2006/0191055 A1 Aug. 31, 2006

(30) Foreign Application Priority Data

Feb. 8, 2002 (IT) ..... BO2002U0013 U

(51) Int. Cl.
*A41D 25/00* (2006.01)

(52) U.S. Cl. ..... 2/144

(58) Field of Classification Search ..... 2/144, 2/145, 146, 150, 153, 156, 152.1
See application file for complete search history.

(56) References Cited

U.S. PATENT DOCUMENTS

| | | | | |
|---|---|---|---|---|
| 5,088,119 A * | 2/1992 | Fortier | ..... | 2/146 |
| 6,205,587 B1 * | 3/2001 | Shiffler | ..... | 2/146 |
| 6,209,136 B1 * | 4/2001 | Ophardt | ..... | 2/145 |

FOREIGN PATENT DOCUMENTS

| | | |
|---|---|---|
| DE | 8618057 U | 11/1987 |
| FR | 683.710 A | 6/1930 |
| FR | 970.262 A | 1/1951 |
| FR | 416.929 A | 11/1965 |
| JP | 2002020507 A | 1/2002 |

* cited by examiner

*Primary Examiner*—Tejash Patel

(57) ABSTRACT

A multilayer necktie consisting of a first portion of fabric defined by three sections joined together without continuity solution to define: a so-called blade of the necktie, standing, when used, in sight of the user; the part around the user's neck; another blade, standing, when the necktie is knotted according to preferable manner, behind the first section and one destined to be partly showing, since it is as wide as, or preferably wider than, the first section. A second portion of fabric is superimposed on this first portion of fabric, which is joined or joinable to the first portion by means of relevant attachments. The resulting necktie is characterized in that, once knotted around the user's neck so as to show, at least partly, three blades, it features a knot in which at least two portions of fabric can be seen.

27 Claims, 14 Drawing Sheets

NECKTIE WITH THREE OR MORE PARTS IN SIGHT AND KNOT WITH TWO OR MORE FABRIC FILMS

This patent application is an improvement of the Italian patent application No. BO98U000080 (patent no. 244759 of Mar. 14, 2002).

The invention relates to a multilayer necktie of various chromatic combinations and, in particular, to a necktie provided with superimposing layers.

Neckties of the type presently known are made of one single portion of fabric of various types (for example silk, cotton, leather etc.) produced according to traditional designs including: a first section defining the main body of the necktie, also called the blade, a second central section, with a width smaller than the width of the previous first section, and destined to be tied around the user's neck in order to obtain, in conjunction with a third section, also called the tail, a knot around the front of the user's neck. Finally, the third section stands, when the necktie is in use, behind the above-mentioned first section of the necktie.

The necktie, being a clothing accessory in constant use, has always been the subject of research to obtain new esthetic-technical solutions that might ease and widen the options of the user wearing it, to match it to the rest of the clothes, according to his personal taste.

For this purpose, the Applicant has designed and produced a multilayer necktie of various chromatic combinations, structured to offer the user a wider and more varied chromatic choice in an extremely practical and easy manner, while maintaining the traditional esthetic shape of the necktie unaltered.

The technical characteristics of the invention, according to the above-mentioned purposes, are clearly described in the claims below and the advantages of the invention will be more evident in the detailed description below made with reference to the attached drawings, showing an embodiment of the invention, purely by way of non-exhaustive example, in which:

Figures 3, 4:
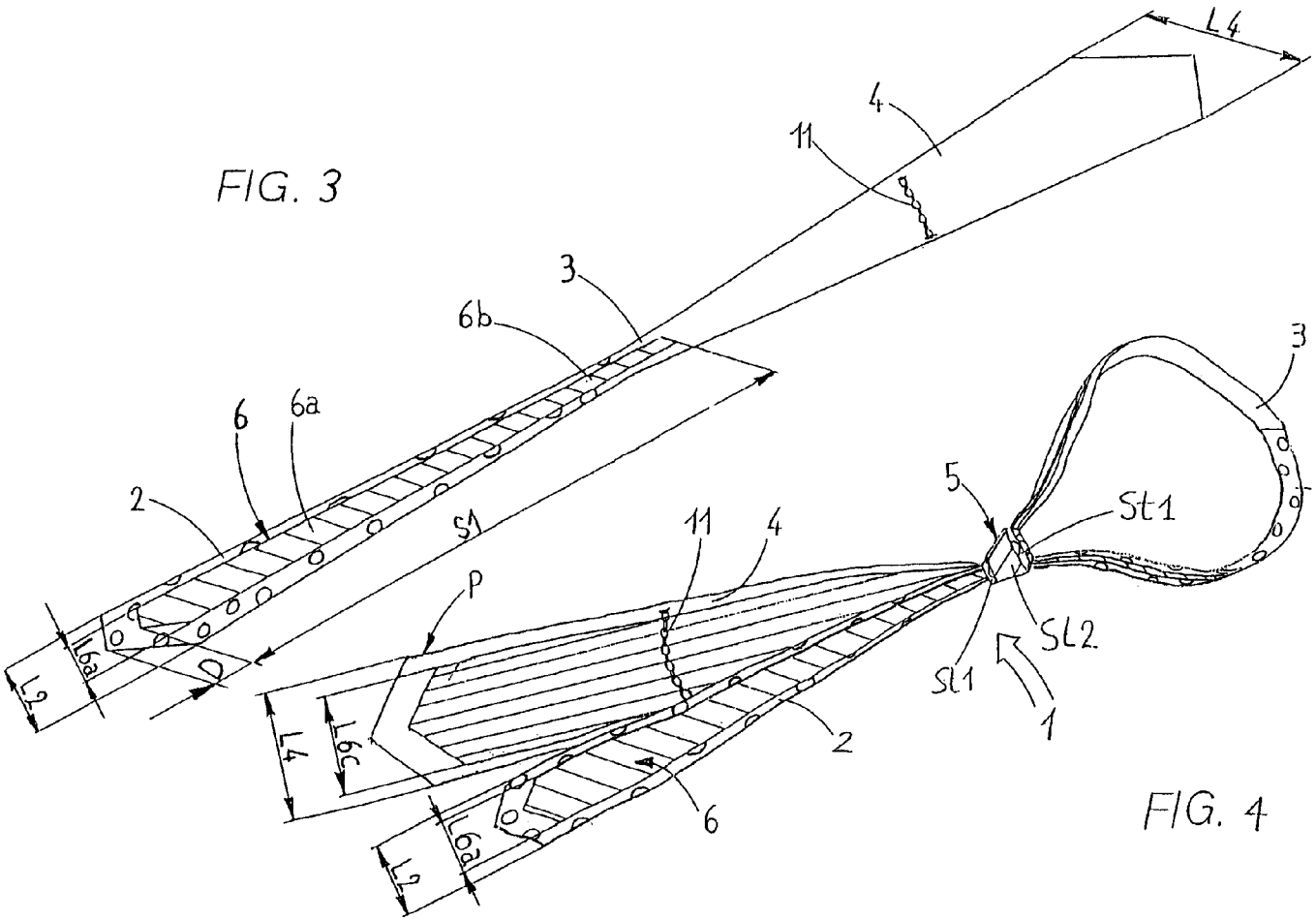
FIG. 3 shows an additional and preferred variant of the multilayer necktie depicted in FIG. 1, in a prospective view.
FIG. 4 shows the necktie depicted in previous FIGS. 1 and 2 in a knotted configuration and in front view.
Figure 5A:
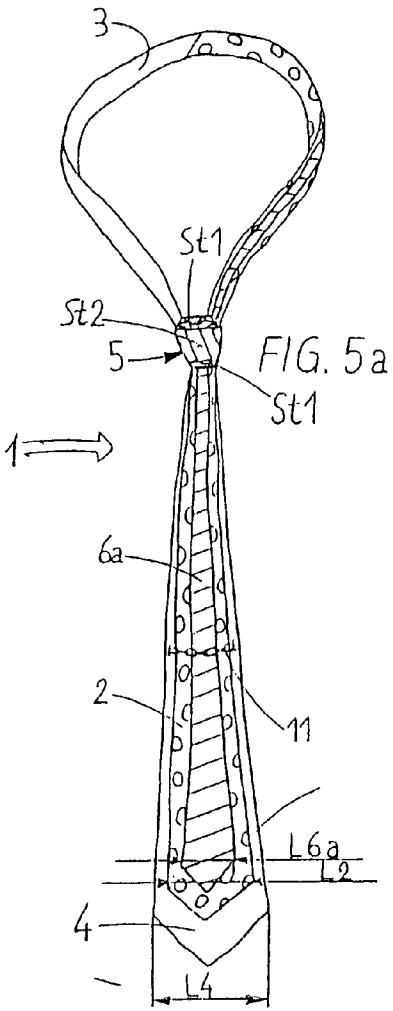
Figure 5:
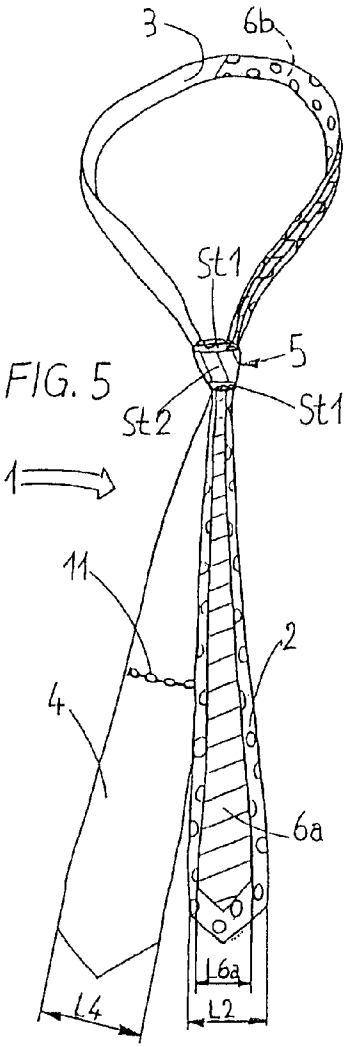
Figure 4A:
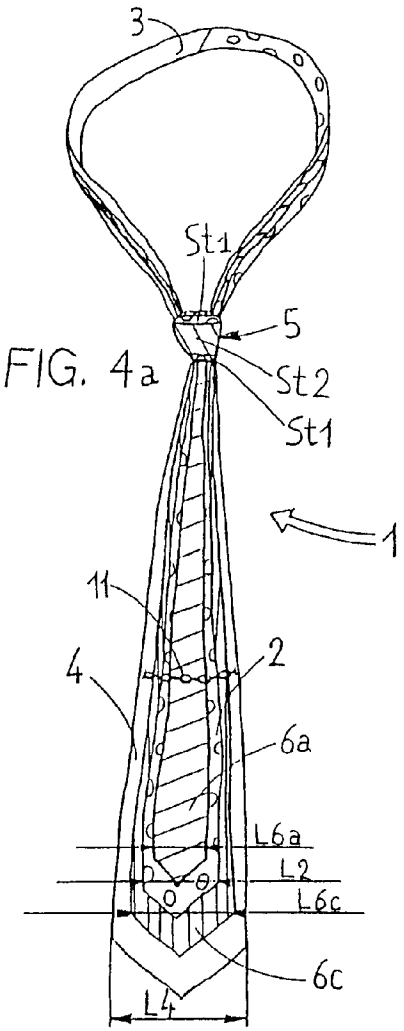
Figure 5B:
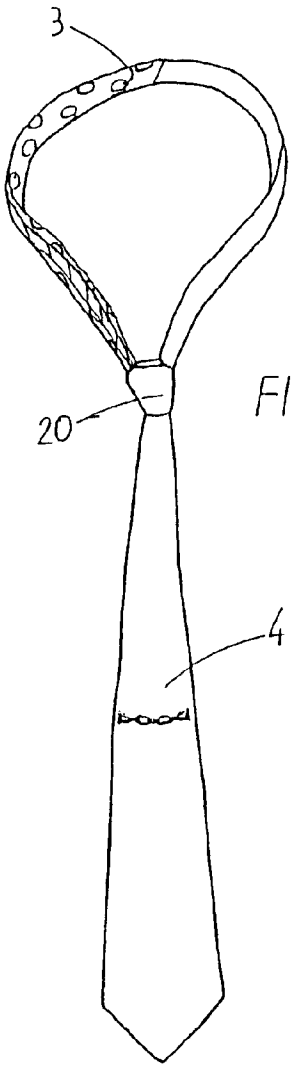
Figure 4B:
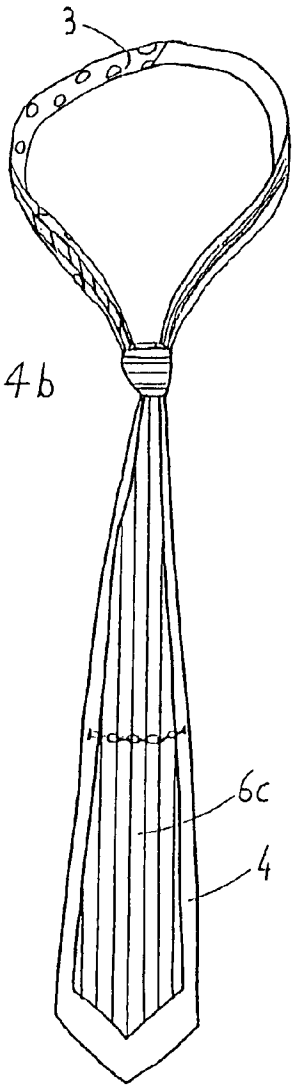
Figure 6:
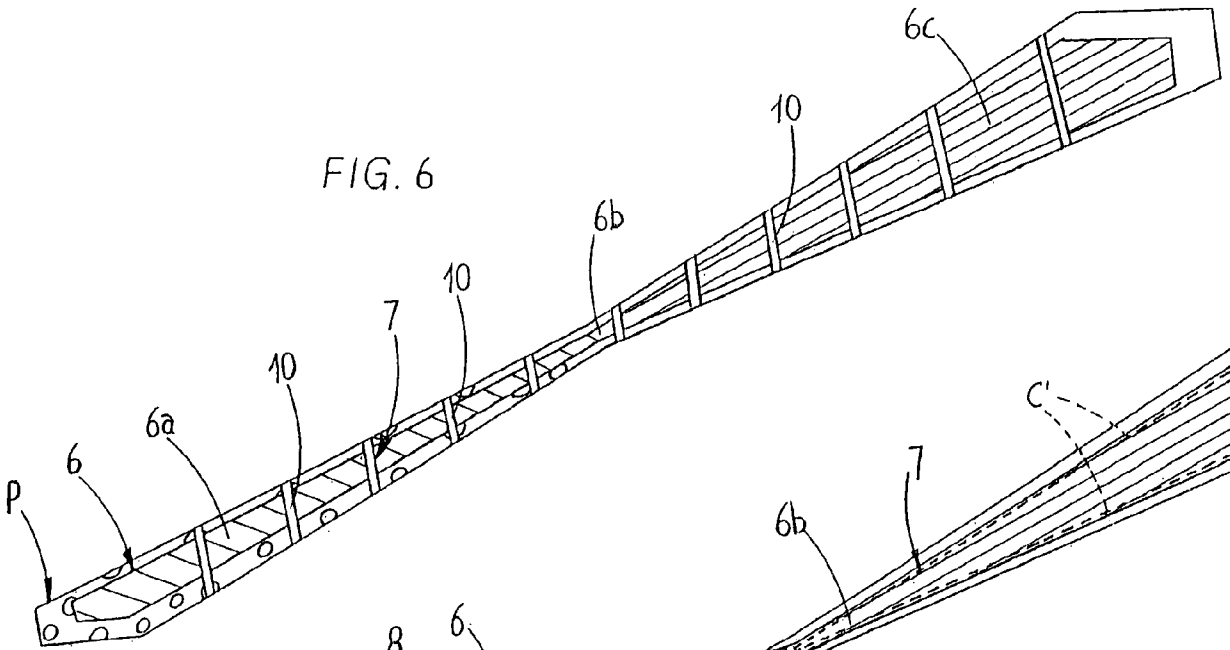
Figure 7:
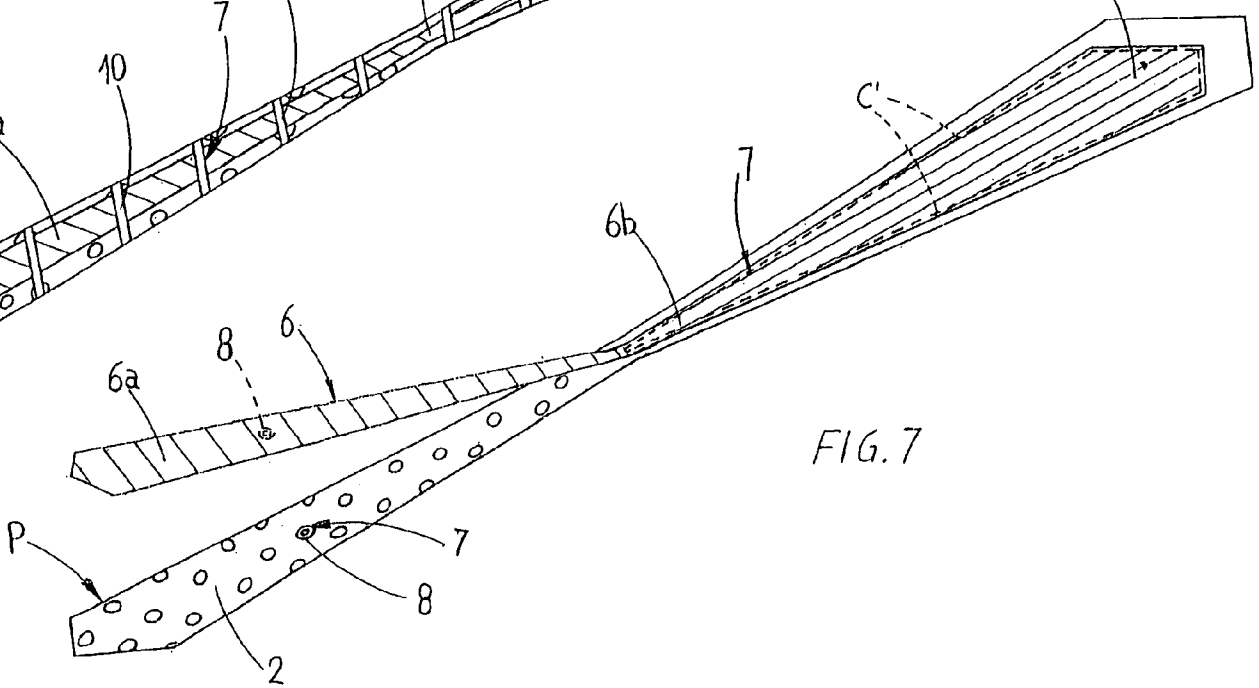
Figures 8, 9:
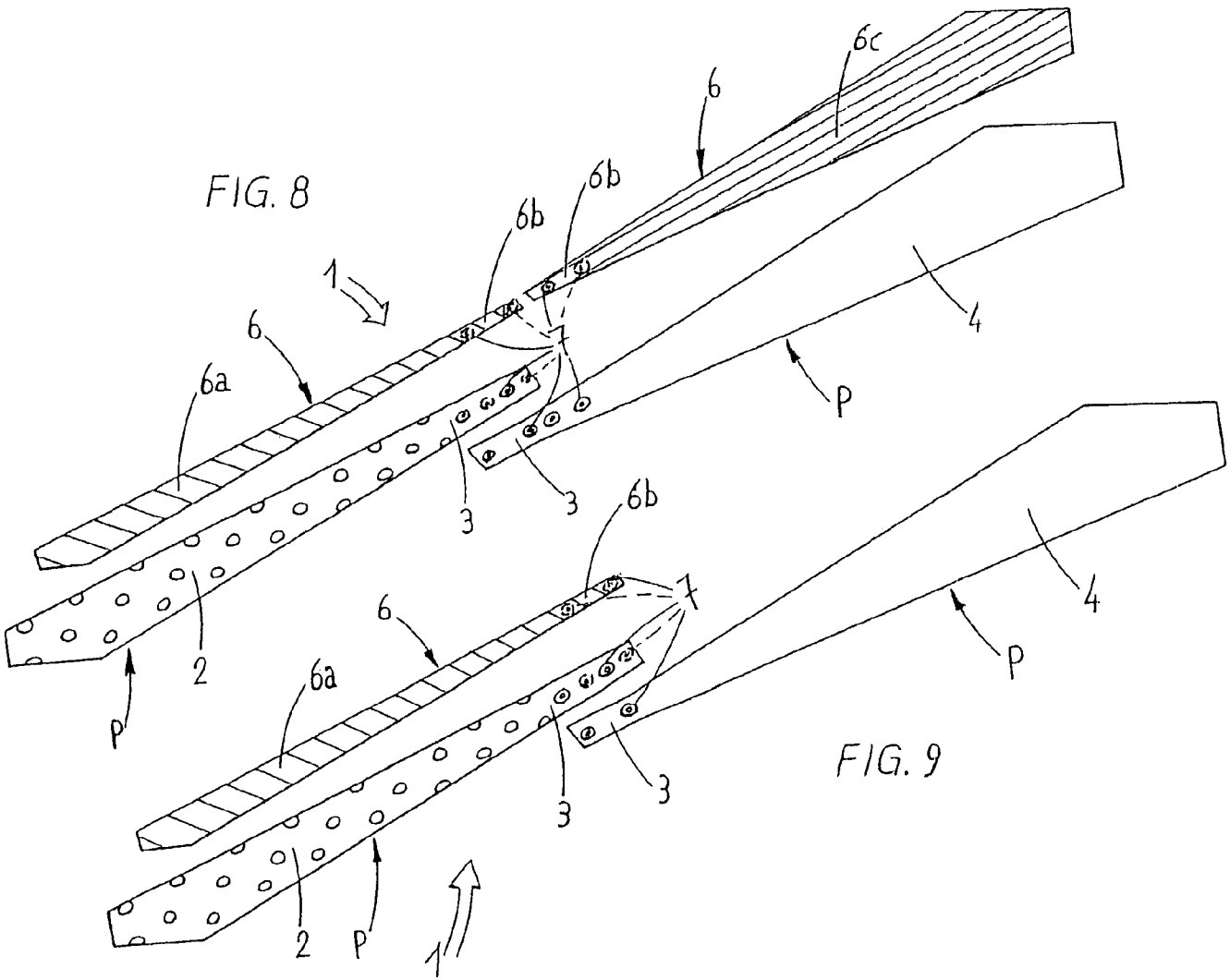
Figures 10, 11:
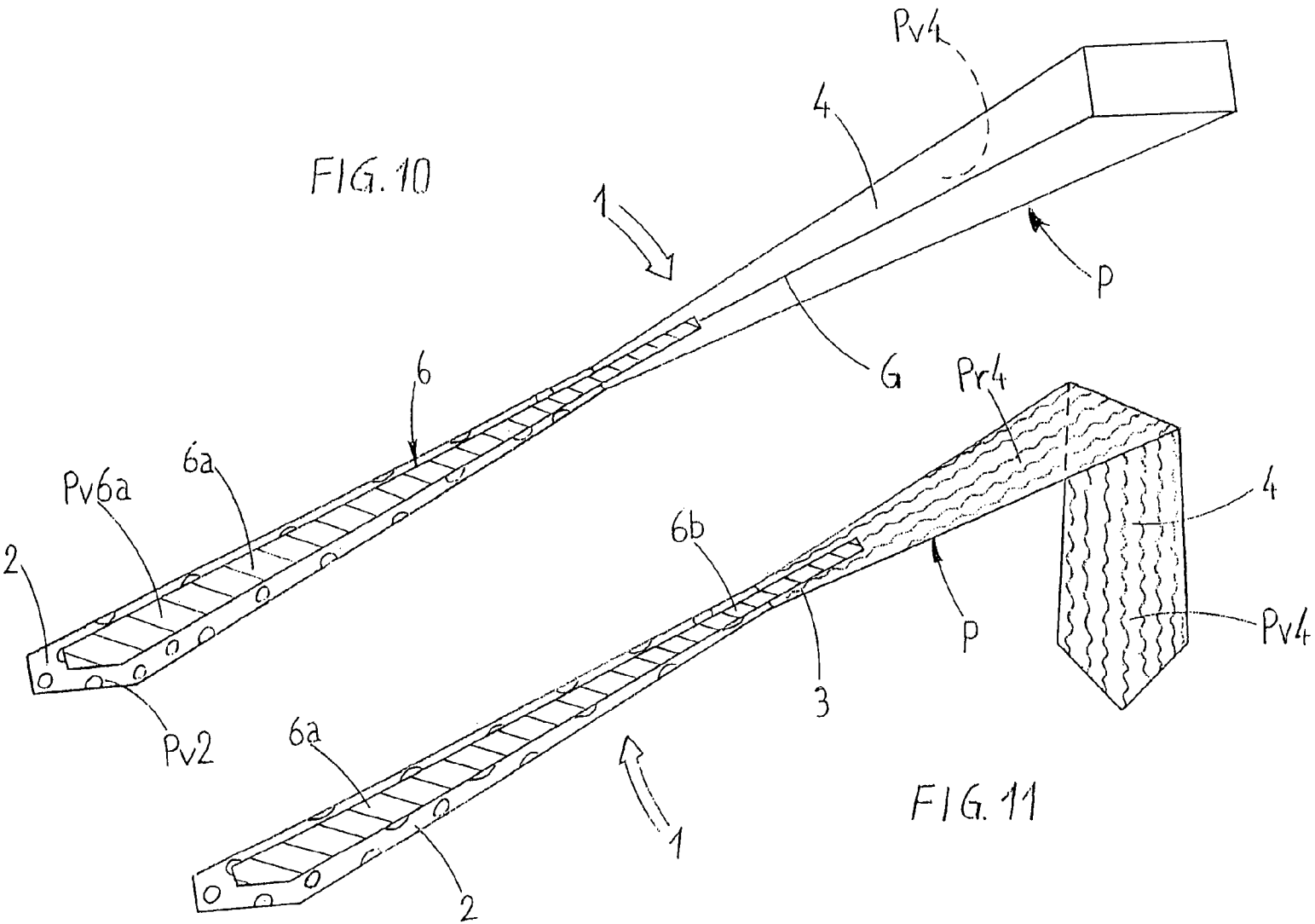
Figure 12:
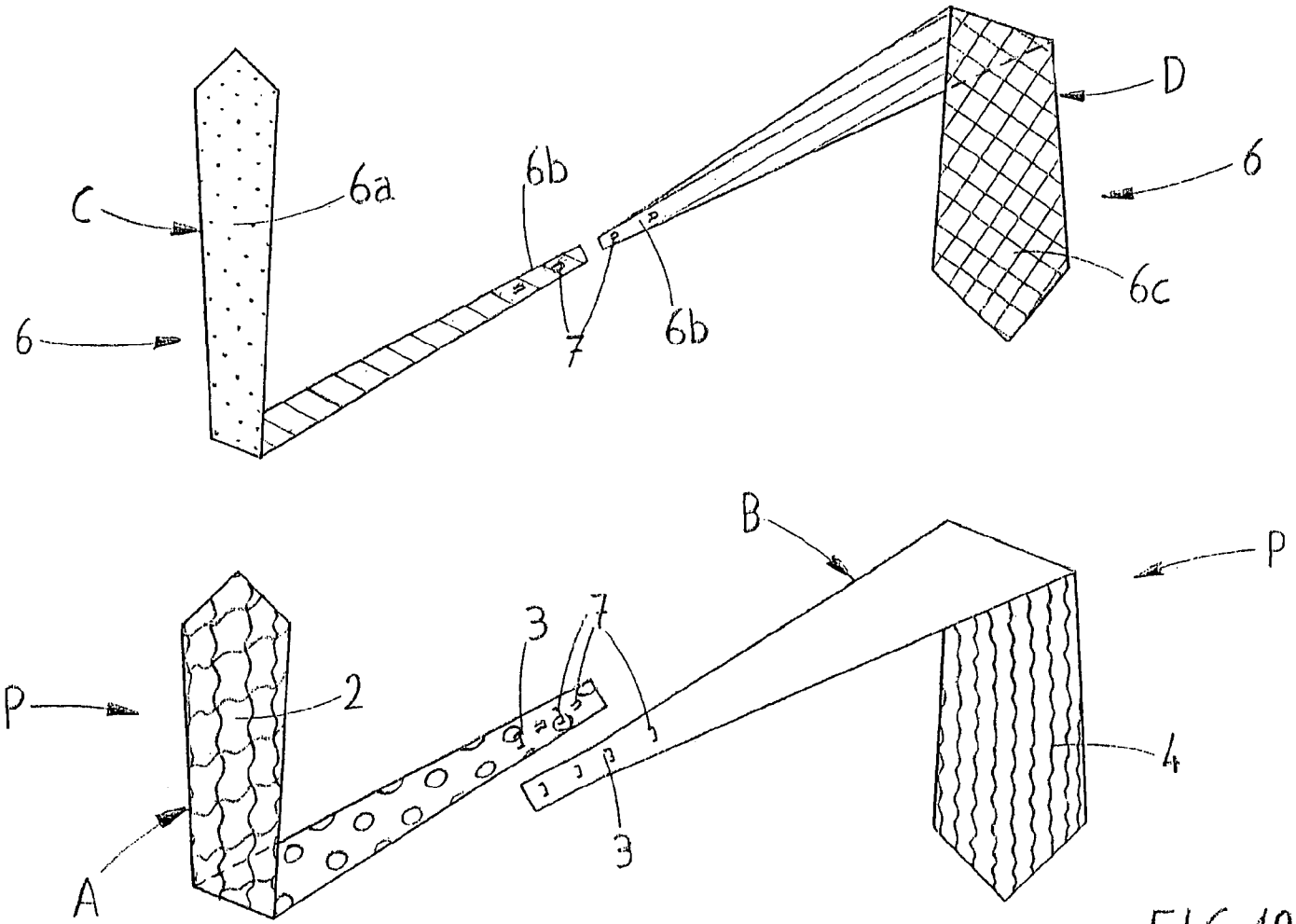
Figures 13, 14:
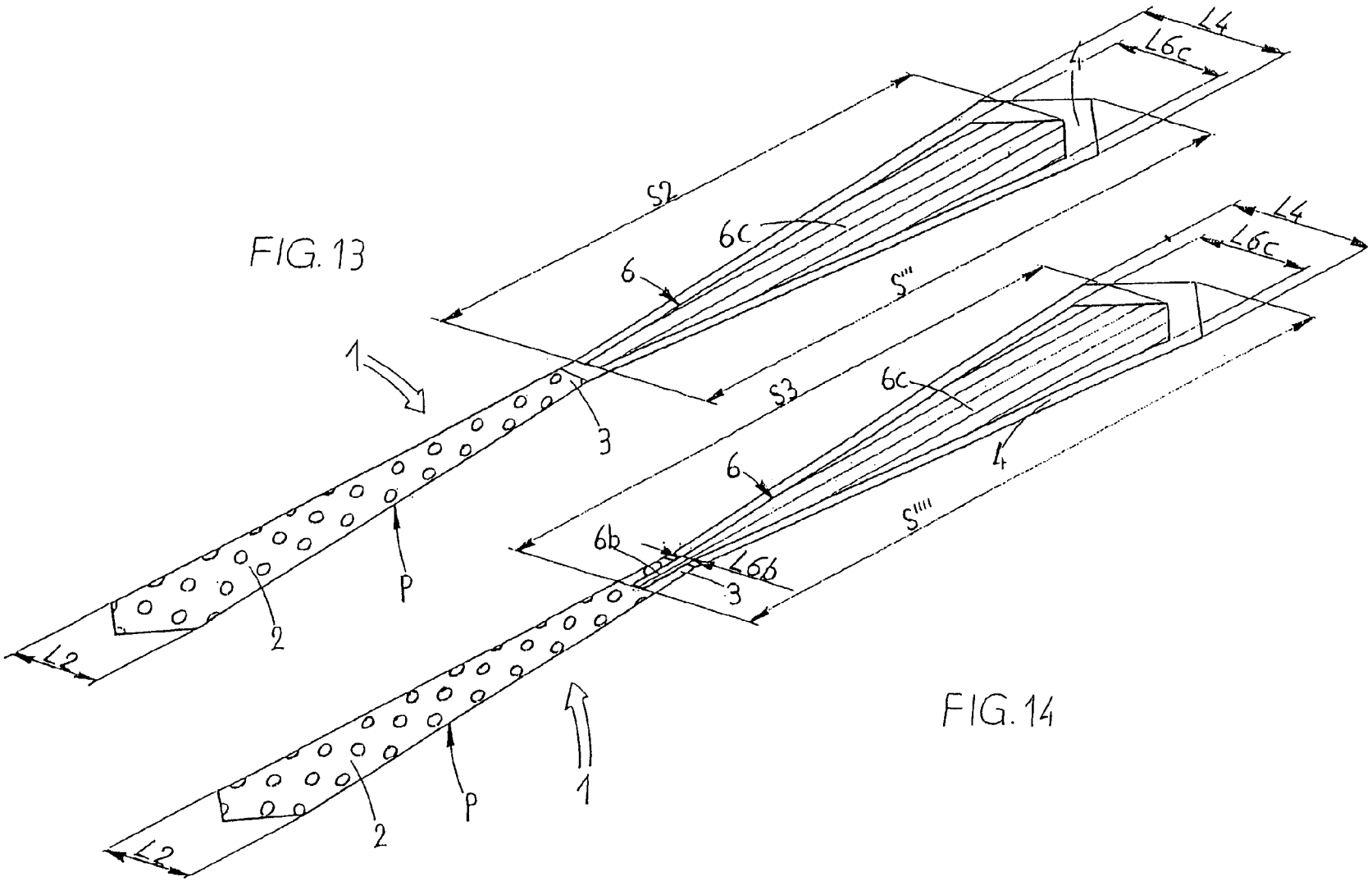
Figure 16:
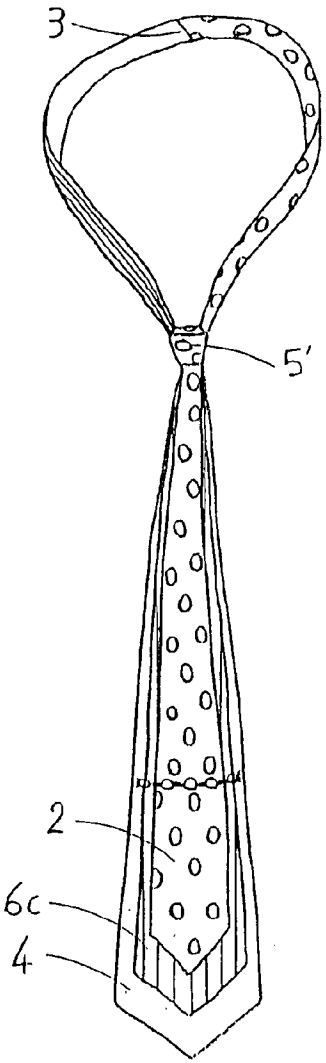
Figure 15:
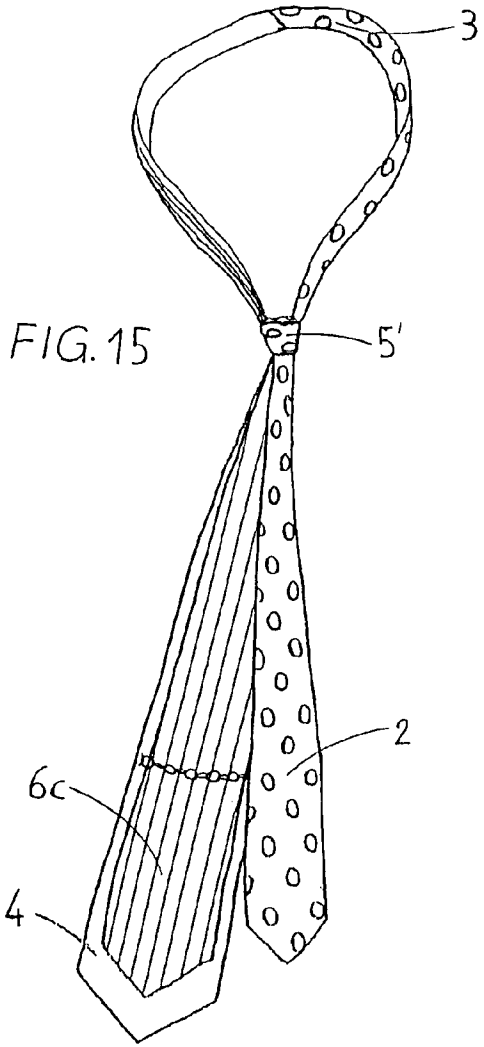
Figure 17:
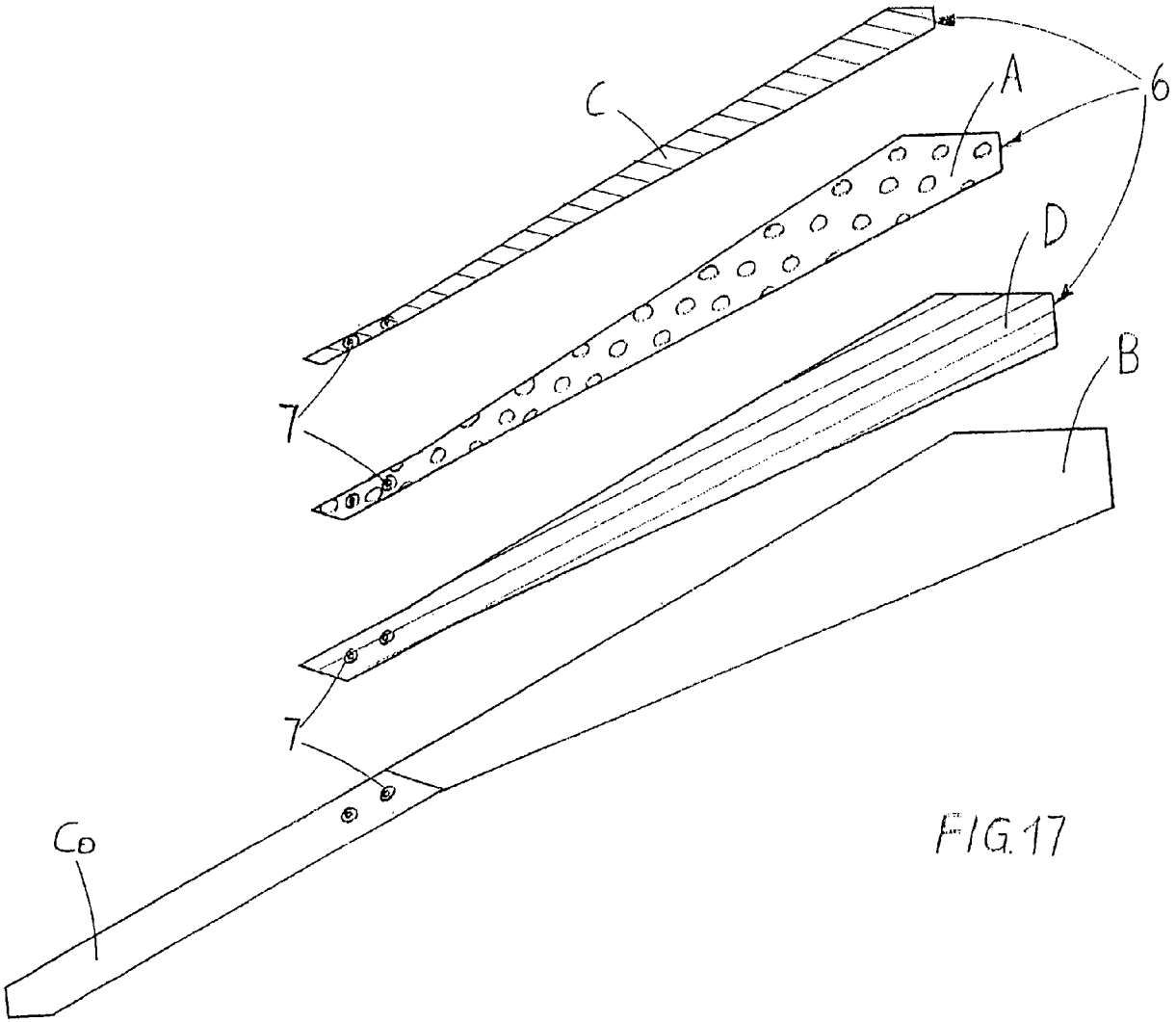
Figure 18:
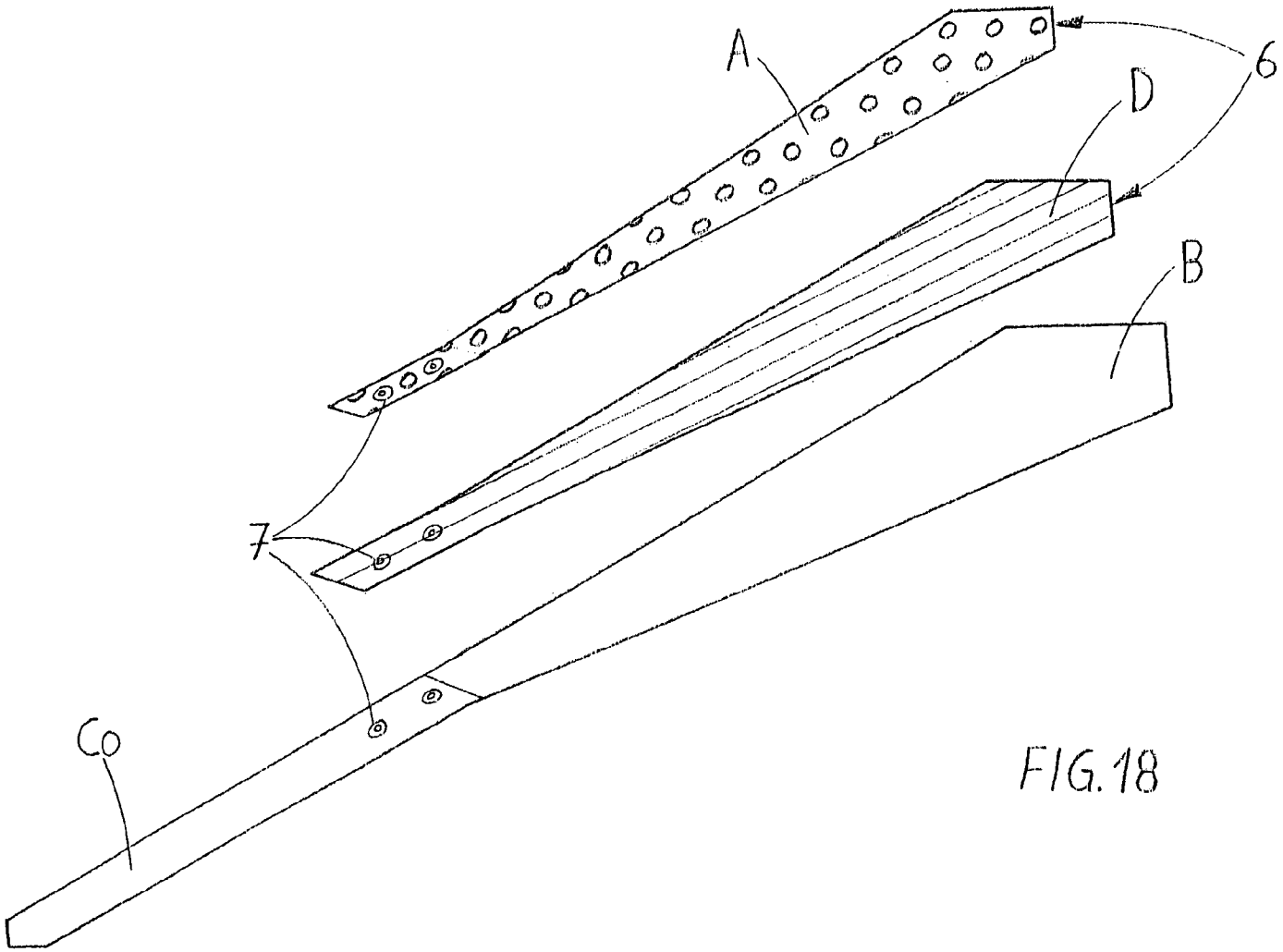
Figure 20:
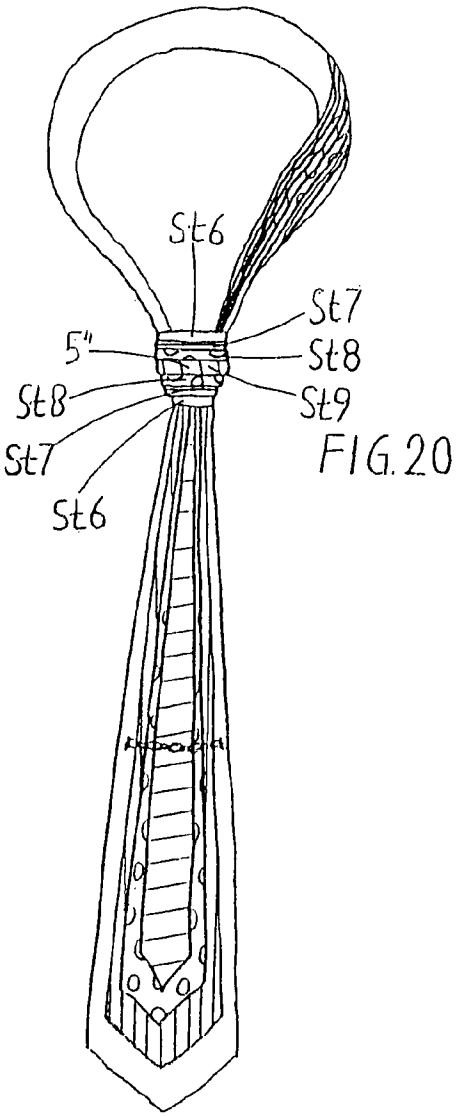
Figure 19:
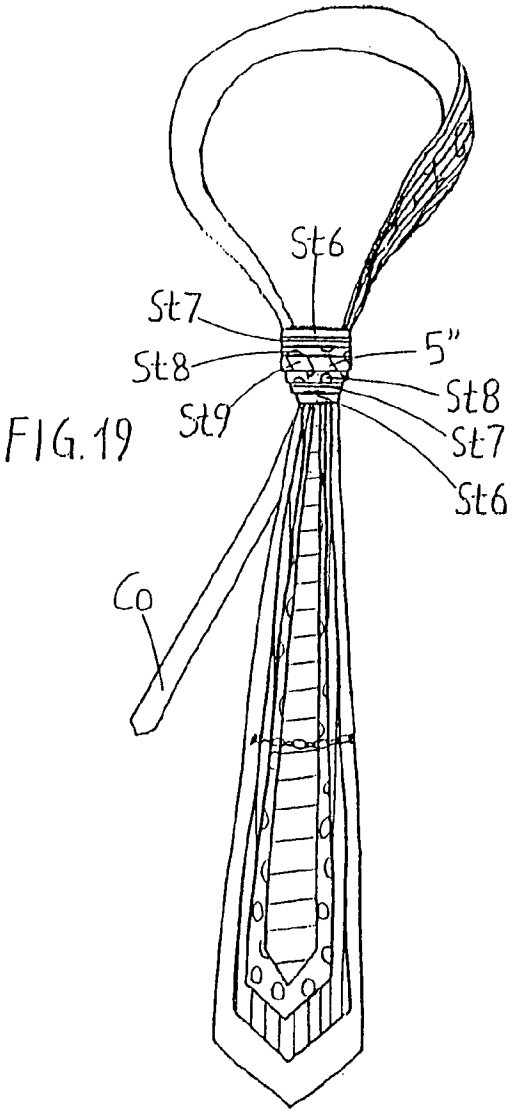
Figure 22:
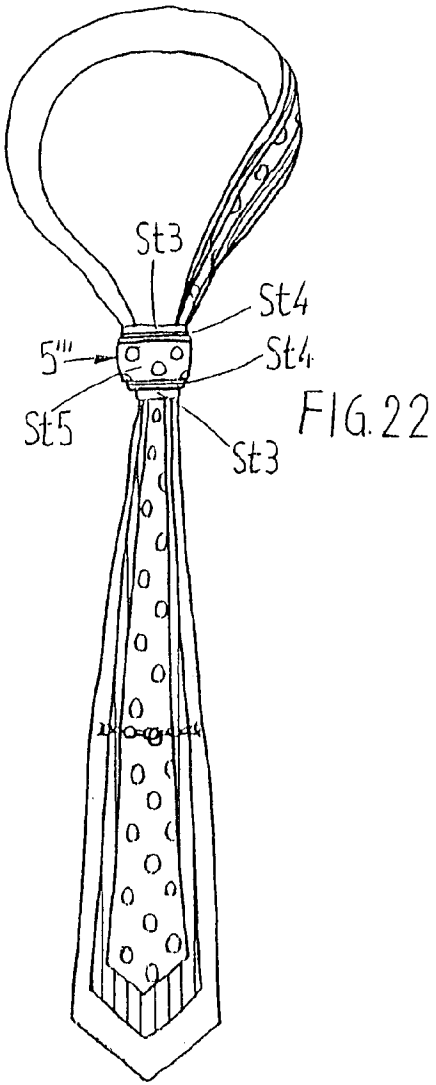
Figure 21:
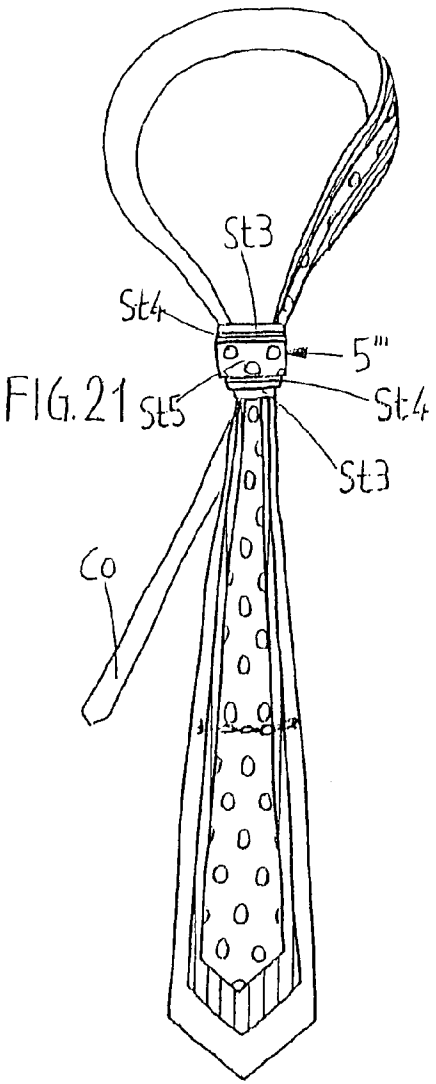

FIG. 4*a* shows the same necktie of FIG. 4, again in front view, but with all four blades, of different sizes, lined up, as they actually tend to be when the necktie is knotted around the user's neck;

FIG. 4*b* shows a front view of the same necktie depicted in FIGS. 1, 2, 4 and 4*a*, but knotted in a different fashion, with the two widest blades showing and the two narrower blades hidden behind the first two ones;

FIG. 5 shows a preferable variant of the necktie according to the invention, already depicted in FIG. 3, in a knotted configuration and in front view;

FIG. 5*a* shows the same necktie of FIG. 5, again in front view, but with all three blades of different sizes lined up as they actually tend to be when the necktie is knotted around the user's neck;

FIG. 5*b* shows, in front view, the same necktie depicted in FIGS. 3, 5 and 5*a*, but knotted in a different fashion, with the widest blade showing on the user and two narrower blades hidden behind the first one;

FIGS. 6 and 7 show two alternative embodiments of the multilayer necktie, according to the invention, both in prospective view;

FIGS. 8 and 9 show two other versions of the multilayer necktie according to the invention, in two exploded prospective views;

FIGS. 10 and 11 also show two variants of the multilayer necktie, according to the invention, in two prospective views;

FIG. 12 shows another variant of the multilayer necktie, according to the invention, in an exploded prospective view;

FIGS. 13 and 14 show two other variants of the multilayer necktie, according to the invention, both in prospective view;

FIG. 15 shows a front view of the neckties depicted in previous FIGS. 13 and 14 after they have been knotted;

FIG. 16 also shows the neckties depicted in FIGS. 13 and 14, in a front view portraying the final look of the above-mentioned neckties once knotted around the user's neck;

FIGS. 17 and 18 show other two variants of the multilayer necktie, according to the invention, in two exploded prospective views;

FIG. 19 shows a front view of the necktie depicted in FIG. 17, after it has been knotted in a preferred and traditional fashion, namely with the so-called tail behind all the other blades;

FIG. 20 shows the necktie again depicted in FIGS. 17 and 19 in a front view portraying the final look of the above-mentioned necktie once knotted around the user's neck in the above-mentioned fashion;

FIG. 21 shows a front view of the necktie depicted in the previous FIG. 18, after it has been knotted in a preferred and traditional fashion, namely with the so-called tail behind all the other blades;

finally FIG. 22, shows the necktie again depicted in FIGS. 18 and 21 in a front view portraying the final look of the above-mentioned necktie once knotted around the user's neck in the above-mentioned manner.

As shown in the figures of the attached drawings, and with particular reference to FIGS. 1 to 4, the multilayer necktie being considered, marked as a whole with 1, consists of a first portion of fabric P defined by three sections 2, 3 and 4 joined together without continuity solution. Each section 2, 3 and 4 defines a part of the necktie in its "knotted" form that can therefore be worn by a user (as shown in FIG. 4): the first section 2 defines the so-called blade of the necktie 1 which, when in use, stands at the front of the user; the second section 3 defines the part around the user's neck and, together with the first section 2, when in use, makes a knot 5 of the necktie that stands at the front of the user's neck; finally, the third section 4 defines another blade also destined to be in view, at least partly.

As shown in FIGS. 4 and 4*a*, the third section 4 lies, with the necktie 1 knotted according to a preferable fashion, behind the first section 2 of the necktie and partly showing, since it is as wide as, or preferably wider than, section 2.

A second fabric portion of fabric 6 is superimposed on this first portion P, which is joined or joinable to the same first portion by means of relevant attachments 7 (better described below).

In a first embodiment of the necktie 1 (as shown with dash line in FIG. 1), the second portion 6 can have an extension S at least equal to the extension S' of the first section 2 and a dimension L6*a*, widthwise equal to, or preferably smaller than, the width L2 of the first section 2: in this way, a total covering, or preferably partial covering, widthwise, of the same first section 2 of the first portion P is obtained.

In a second and preferable configuration of the necktie 1 being considered (as shown with dash line in FIG. 1), the second portion 6 can have an extension S1 equal to the expansion S" resulting from adding the extensions of the first and second section 2 and 3 of the first portion P. Also in this case, the width sizes L6*a* and L6*b* of the second portion 6 are equal to, or preferably smaller than, widths L2 and L3 of the two corresponding sections 2 and 3 in order to achieve a partial covering of the first and second section of the first portion P.

This second and preferable embodiment can be seen also in FIG. 3, where the length S1 of the second portion 6 is equal to, or shorter than, only by value D, the sum of the lengths of section 2 and 3 of the first portion P.

Figures 1, 2:
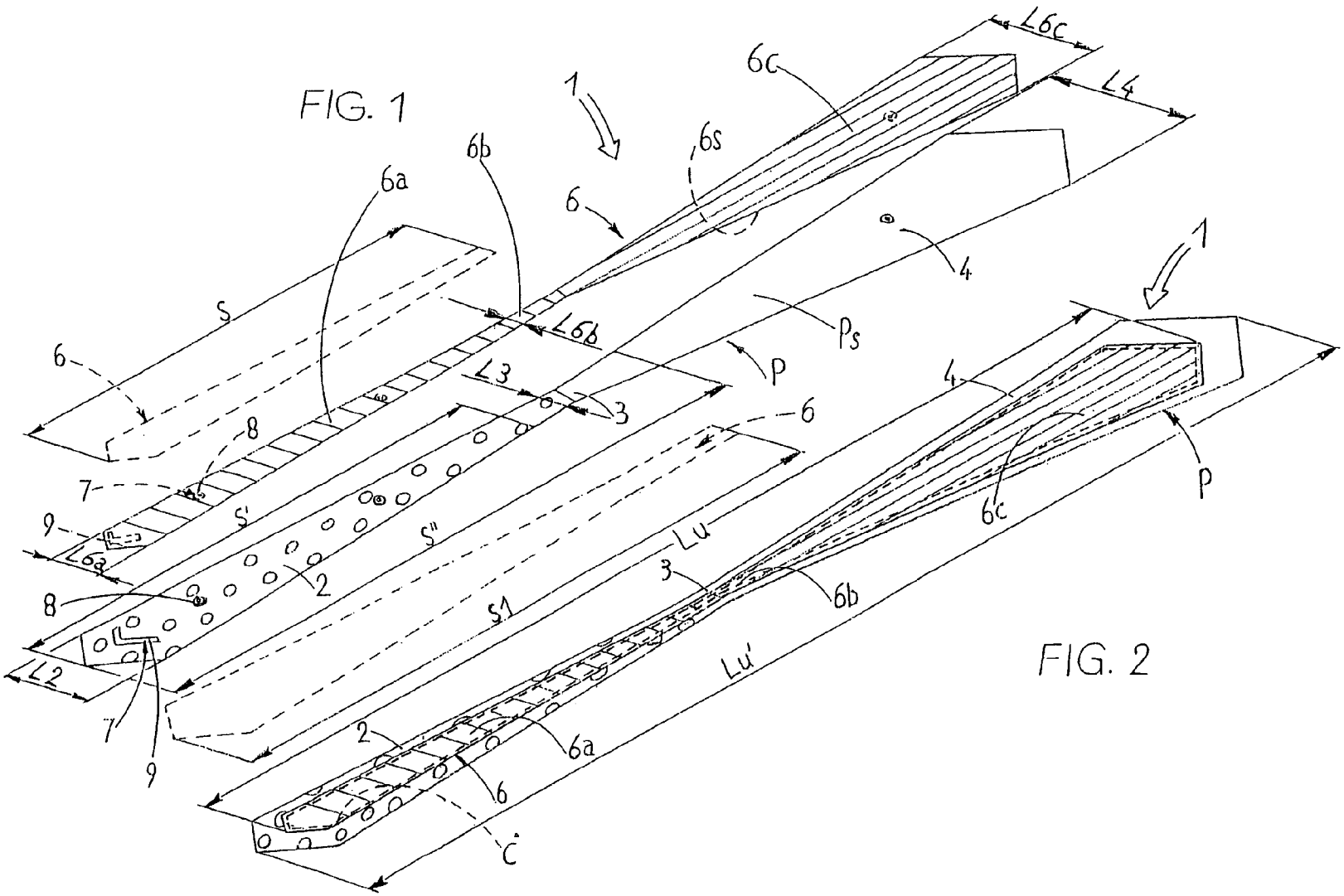
FIG. 1 shows a multilayer necktie, according to the invention, in an exploded prospective view.
FIG. 2 shows a further variant of the multilayer necktie depicted in FIG. 1, in a prospective view.

In a third embodiment depicted in FIGS. 1 and 2, the second portion 6 can consist of three sections 6*a*, 6*b*, 6*c*, similar to the above-mentioned first, second and third sections 2, 3 and 4 of the first portion P. Also in this third case, the width sizes L6*a*, L6*b* and L6*c* of the second portion 6 are equal to, or preferably smaller than, widths L2, L3 and L4 of the corresponding three sections 2, 3 and 4, so as to achieve only a partial covering of the first, second and third section of the first portion P. Preferably, he first, second and third section 6*a*, 6*b*, 6*c* of the second portion 6 define a length Lu shorter than the length Lu' of the corresponding three sections 2, 3 and 4 of the first portion P, in order to obtain such a superimposition as to achieve a uniform vision of both portions P and 6 of the necktie 1.

As it can be seen in FIGS. 1, 2, 4 and 4*a*, the third section 4 of the first portion P has a width L4 equal to, or preferably greater than, the width L6*c* of the third section 6*c* of the second portion 6; length L6*c*, in turn, is equal to, or preferably longer than, the width L2 of the first section 2 of the first portion P; length L2, in turn, is equal to, or preferably longer than, the width L6*a* of the first section 6*a* of the second portion 6.

Likewise, in the preferable case of a necktie made according to the invention, having only three blades, as shown in FIGS. 3, 5 and 5*a*, the width L4 of the third section 4 of the first portion P will be equal to, or preferably greater than, the width L2 of the first section 2 of the first portion P; in turn, this width L2 will be equal to, or preferably greater than, the width L6*a* of the first section 6*a* of the second portion 6. All of this has the clear aim of showing, when the necktie is knotted around the user's neck, at least one portion of the three or four blades included in the necktie, each one with its own characteristics in terms of fabric, color, pattern etc.

This objective, i.e. showing at least one portion of the three blades included in the necktie according to the invention, when it is knotted and in sight on the user, can also be reached by producing neckties like those depicted in FIGS. 13 and 14, that are similar to those that are the subject of the above-mentioned patent application No. BO98U000080. In FIG. 13 the second portion 6 consists of the section 6*c* with an extension S2 equal to, or slightly shorter than, the extension S'" of section 4 of the first section P; the width L6*c* of said section 6*c* of portion 6 is equal to, or preferably smaller than, the width L4 of the third section 4 of the first portion P and equal to, or preferably greater than, the width L2 of the first section 2 of the first portion P. In FIG. 14, on the other hand, the second portion 6 consists of sections 6*b* and 6*c* and has an extension S3 equal to, or slightly smaller than, the extension S"" consisting of sections 3 and 4 of the first portion P; the widths L6*b* and L6*c* of the above-mentioned sections 6*b* and 6*c* of the portion 6 are equal to, or preferably smaller than, the widths of the corresponding sections 3 and 4 of the first portion P and equal to, or preferably greater than, width L2 of the first section 2 of the first portion P. In both of the above-mentioned cases, however, the neckties depicted in FIGS. 13 and 14 will feature a knot 5' (see FIGS. 15 and 16), when all three blades are in sight on the user, different from the previous knot 5 that can be obtained with the neckties depicted in FIGS. 1 to 3: the knot 5', in particular, will be monochrome, whereas knot 5 in FIGS. 4, 4*a*, 5 and 5*a* consists, as shown in the relevant figures, of two components St1 and St2 that can be referred to as strips, having different chromatic characteristics. Furthermore, knot 5' must be made with a strip of fabric too thin to be aesthetically acceptable, for portion 6*c* in FIGS. 15 and 16 to be well visible, though only partly, also in the upper part of the necktie, namely in contact with the knot 5'. This particular aesthetic look of knot 5 of the necktie produced according to the invention, which is easily distinguishable from traditional necktie knots (which is what 5' can be said to be) because of its two colors, is an extra element aimed at facilitating aesthetic matching when the user is choosing what necktie to wear. For example, it can be noticed how knot 5, made with a double strip of fabric, suits double-collar shirts very well—that are currently very fashionable—or provides a range of colors to facilitate, as already said, the suitability with the rest of the clothing items, especially when the necktie considered is worn covered, maybe almost completely, by a waistcoat or a "V" neck pullover.

More clearly, the neckties that are the subject of this application differ from said neckties like the one illustrated in the above-mentioned patent application No. B098U000080 (Italian patent 244759 of Mar. 14, 2002) owing to the fact that they do not present the following drawbacks:

a) the height of the knot is never so small that it does not match with the rest of the necktie (which is something that would happen when tying the above mentioned necktie, having two blades superimposed at one end and a tail that is narrower than the two superimposed blades at the opposite end, in a way to display three separate blades visible on the user);

b) a knot sufficiently matching the rest of the necktie cannot be obtained by tying a necktie consisting of two blades superimposed at one end and one tail that is narrower than the two mentioned blades at the opposite end, in a way that it displays three blades always visible at the same time or is obtainable only by renouncing the aesthetic harmony of the rest of the necktie and in particular of the area under the knot, where the top areas of the underlying blades 6C and 4 would disappear as they would be covered by blade 2, stretched in order to obtain a more harmonious height of the knot, and therefore with the knot as a whole, compared to the rest of the necktie;

c) the simultaneous presence of the two separate strips of fabric visible on the knot, preferably with different pattern and/or color etc. (whose edges generally form three or four almost horizontal segments) and of the three or more separate blades also visible, is not easily achievable with a necktie consisting of two blades superimposed at one end and one tail that is narrower than both blades at the opposite end, even more so when considering that the necktie features a moving" model and in this case the movements, that is the adjustments that lead the user to loosen or tighten the necktie's knot during its use, easily lead the mentioned necktie not to simultaneously show the two separate superimposed strips of fabric in the knot and the three blades in view anymore (the two strips in the knot disappear completely or partially following these movements, thereby eliminating one additional original element—indeed, the two separate superimposed strips already on their own enable the viewer to understand that the necktie he/she is looking at is not of traditional type,—furthermore, the upper edge of the seam of the middle area (6*b*) of the superimposed blade (6) may unaesthetically appear on the knot or right below it);

d) again with the aim of obtaining a necktie that has an impact on the viewer due to its unprecedented originality, displaying three or more separate superimposed blades, it may also be added that the most complex types of knot cannot be made using as active part, to be wrapped around the passive part, just the tail of a necktie having two superimposed blades at the opposite end of the mentioned tail, unless the unaesthetic turns made with the active tail to obtain the knot are exposed (from an aesthetic point of view, it would better to hide them from view so that the knot can appear as perfect and as "clean" as possible); otherwise, an attempt can be made to make these complex knots in an aesthetic fashion, although in this case the active tail used for making the knot must have such a width that the mentioned necktie would result in presenting the drawback of top areas of the underlying blades 6*c* and 4 under point b;

e) unless it is fixed with a tie-pin for example or with other suitable means, the smallest blade 2 of a necktie featuring three blades simultaneously visible and obtained by tying a necktie having two blades superimposed to one end and a tail narrower than mentioned two blades at the opposite end, moves in a rather unaesthetic fashion, like an isolated piece, furthermore the most visible among the three (which highlights the clear lack of aesthetics of such a solution), in addition to tending to rotate around its vertical axis, since it is rather narrow: this element further highlights the disharmony that the mentioned necktie with two superimposed blades on one side and one narrower tail on the other side features when it is tied in a way to show all three blades in view at the same time.

Naturally, a different aesthetic look of the necktie would be achieved, obviously for improvement purposes, even if all or part of the blades were made of the same fabric, color and pattern, if any.

The neckties that are subjects of this application differ clearly even from the known neckties made of pleated fabric which, owing to their pleated blades, may look similar to neckties having superimposed blades of different length (therefore may look similar, for example, to the neckties illustrated in FIG. 5*a* of this application), but in reality can in no way be exchanged for them, since the plated "blade" effect is easily distinguishable from two or more single superimposed classic blades.

This is true in any case and therefore even more so when considering that the superimposed blades of the neckties that are the subject of this patent application are, at least partially, able to move one from the other also when in use by the user; this movement cannot certainly be made by fake pleated "blades", which remain always reciprocally fixed, while the profiles of the tips of the fake pleated blades lie always next to each other (in the neckties with pleated "blades", this lower profile, when looking at the necktie in use by the user from the front, is made up of various segments roughly aligned to form one single segment—or maximum two, in the classical shape of "V"—which represents the lower edge of the pleated necktie) and this confers the pleated necktie a different aesthetic character compared to the neckties that are the subject of this application, in addition to, above all, suggesting to the viewer that the pleated necktie might in reality be a necktie made up of single superimposed and in any case separate blades, but may also be, as it actually is, a simple pleated necktie: therefore, it cannot be unmistakably perceived as a special necktie never seen before, different from normal neckties featuring one single blade and one single tail and the fact of not being able to absolutely exclude the possibility that it may simply be a pleated necktie makes it a normal necktie that is very likely to consist, for those who see it, of one single tail and one single blade, even if pleated. On the contrary, all the neckties that are the subject of this patent application allow the viewer to immediately deduce that they are particularly original neckties that clearly differ from the normal neckties featuring one single blade and one single tail, even if it were just for their tips that cannot be obtained by simply pleating one single piece of fabric or other material (without considering the already mentioned distinguishing features of the separate superimposed "blades" as compared to fake "blades" which the pleating, if you wish, may generate with its aesthetic effect and the possibility of moving, at least partially).

Therefore, in conclusion, whoever observes even for just a second any of the neckties that are the subject of this application will immediately deduce that it cannot have been obtained by simply pleating the fabric (or other material) of one blade and, by displaying one or more blades, it cannot consist of just one blade and one tail like classic neckties, thereby immediately perceiving that this a particularly original necktie never seen before.

With reference to FIGS. 1, 2 and 4*b* it should be pointed out that the widths L4 and L6*c*, of sections 4 and 6*c* respectively, are equal to, or preferably greater than, the width L6*a* of section 6*a* and the width L2 of section 2, also so that sections 6*c* and 4 can cover both sections 6*a* and 2, as shown in FIG. 4*b*, simply by knotting the necktie around the user's neck in a different fashion. In this way, the same necktie can display, when worn by the user, two single blades, instead of four. The same necktie can therefore feature two different aesthetic looks when knotted around the user's neck.

Likewise, with reference to FIGS. 3 and 5*b*, it can be seen that in the case of a necktie with only three blades, as preferable, the width L4 of the third section 4 of the first portion P is equal to, or preferably greater than, the width L6*a* of the section 6*a* and the width L2 of the section 2, also so that section 4 can cover both sections 6*a* and 2, as depicted in FIG. 5*b*, simply by knotting the necktie around the user's neck in a different fashion. Therefore, the necktie in FIG. 3 can look as shown in FIG. 5*b*, namely like a totally traditional necktie, also in the knot, showing only one blade on the user. The same necktie in FIG. 3, with a configuration preferred to the one in FIG. 2, can take on two different aesthetic looks when knotted around the user's neck, showing only one blade or three blades according to the user's preferences.

FIGS. 8 and 9 (the model shown in FIG. 9 represents another embodiments of the novel neckties having particularly efficacy) show two additional exploded versions of the necktie 1 in which the already mentioned sections 2, 3 and 4 of the first portion P and 6*a*, 6*b* and 6*c* (the latter only shown in FIG. 8) of the second portion 6, are clearly visible and can be joined by the necktie producer or by the user, by means of attachments 7, so as to obtain the two already mentioned portions P and 6 making up the final necktie 1.

As it is well known, there are different ways of making the knot 5 of a necktie, which is visible, for example, in FIGS. 4*a* and 5*a*. In order to allow the user of a necktie according to the invention, to knot it the way he pleases, the necktie 1 can have, when laid on a base, like in FIG. 10, the surfaces of the blades destined to be visible when the necktie is knotted around the user's neck, not all facing the same side:

in the case in FIG. 10, for example, sections 2 and 6*a* have their respective surfaces Pv2 and Pv6*a*, i.e. those surfaces that for each of the above-mentioned blades will be destined to be visible on the user, both facing upwards; the section 4 of the first portion P, on the other hand, has its surface, destined to be visible on the user and marked with Pv4, facing downwards, therefore the opposite side compared to Pv2 and Pv6*a*, while the surface that can be called Pr4 rear with the traditional line connection G will be facing upwards.

Again for the same reason, namely to allow the user to knot the necktie as usually done with a traditional necktie or as the user prefers, the necktie according to the invention, can be made as depicted in FIG. 11, showing a necktie 1 having the second and the third section 3 and 4 of the first portion P made in "reversible" fashion, a widely known fashion, i.e. with both surfaces Pv4 and Pr4 of the blade (consisting of sections 3 and 4) suitable to be visible on the user, without the line connection G that is usually present on the back of any traditional necktie.

The two surfaces Pr4 and Pv4 are depicted as the same in FIG. 11, but, naturally, they could also be made of different fabrics and/or with different chromatic patterns: in this case the reversible option of sections 3 and 4 of the first portion P is not so much meant to allow the user to knot the necktie in the way he prefers, but to give the user another option when choosing the final chromatic combination of the necktie.

FIG. 12 shows an exploded view of a necktie according to the invention, consisting of four portions A, B, C and D, which in turn include the usual sections 2, 3 and 4 of portion P (which in turn in this case consists of portions A and B) and sections 6*a*, 6*b* and 6*c* of portion 6 (which in turn in this case consists of portions C and D). The peculiarity of this additional variant of a necktie according to the invention lies in that each portion A, B, C and D (or only some of them) is reversible and is matched to the others by means of attachments 7, according to the preferences of the user, who can choose for each of the portions A, B, C and possibly D, which side to show, thereby selecting the final aesthetic combination of the necktie.

Finally, it is possible to have a necktie made according to the invention, in which the first portion P consists of the already mentioned portion B and the second portion 6 consists of the already mentioned portions D, A and, possibly C (in the case of a necktie with four blades), arranged, in an irresolvable manner by the producer or resolvable by the user, one on top of the other (see FIGS. 17 and 18). By knotting the above-mentioned necktie in a traditional fashion, namely in such a way that the so-called tail Co remains behind all of the other sections, with the necktie knotted and visible on the user, knot 5" (see FIGS. 19 and 20), formed by four different visible strips of fabric St6, St7, St8, St9, for the necktie with four blades in FIG. 17, and knot 5'" (see FIGS. 21 and 22), formed by three different visible strips of fabric St3, St4 and St5, for the necktie with three blades in FIG. 18, are obtained respectively.

The necktie 1 obtained by superimposing the two portions P and 6 is kept in this configuration by means of the above-mentioned attachments 7, which can be of the irreversible type (see FIG. 2 in particular) and stand between two non-visible counter-faced surfaces of the two portions P and 6. In the case illustrated, and purely by way of example, the two portions P and 6 are held by a series of stitches C along the perimeter of the second portion 6.

In another embodiment, the second portion 6 can be bound to the first portion P by means of attachments 7 of the reversible type, which always stand between two counter-faced surfaces Ps and 6s of the two portions P and 6. Purely by way of example, the above-mentioned attachments 7 can include a series of popper buttons 8 evenly placed between the two counter-faced surfaces Ps and 6s of the two portions P and 6 (see FIG. 1).

A reversible variant of the above-mentioned attachments 7 (see FIG. 1) can include several strips 9 of material applied to the relevant counter-faced surfaces Ps and 6s of the two portions P and 6, fitted with a tear attachment/detachment surface 10, reciprocal (for example, this material could be what is commercially known as "Velcro").

Two additional alternative embodiments of the above-mentioned attachments 7 are shown in FIGS. 6 and 7: in FIG. 6 the second portion 6 is superimposed on the first portion P and held by the same by means of a series of small transversal bands 10 in line with the first portion P and suitable to be bond to the second portion 6, that can be replaced by unbinding it from the first portion P; in FIG. 7 the above-mentioned attachments 7 include a series of stitches C' binding the second portion 6, in the second and third section 6*b* and 6*c*, to the first section P, while the first section 6*a* is firmly bound to section 2 for example by means of one or more of the above-mentioned popper buttons 8 or by means of a chain 11 (see FIGS. 3, 5 and 5*a*) linked to the first portion P which, when the necktie is being worn by the user, joins section 6*a* with section 2 and these two, in turn, with section 4. In the less preferable case of a necktie with four blades rather than three, the same chain 11 linked to the section 4 of the first portion P (see FIG. 4 and 4*a*) can join, when the necktie is knotted around the user's neck, all three sections 6*a*, 2 and 6*c* to the above-mentioned section 4.

In this case appear obvious that the mentioned blades (three, in the preferred embodiment) may be equipped with adjustment means (7) with the primary purpose of adjusting the total length of the necktie, so that it better adapts to the various heights of the users and their preferred method of tying it, and adjust the reciprocal position of the blades, also when the necktie is already tied. In this case, which represent a preferible embodiment of the tie composed by three blades, the small (6*a*) and medium (2) blades may be stitched together and the first portion of tie so obtained may be associable to the large blade (4), representing the second portion of the tie, with reversible and adjustable means (7).

A necktie with this structure reaches the set objectives thanks to a very simple arrangement that allows the user, particularly in the version with interchangeable portions, to choose in a fast and easy manner the chromatic matching and the patterns of the portions of the necktie according to the other items of clothing he has decided to wear.

The wider choice offered and the special arrangement of the necktie in no way alter the aesthetic characteristics of the necktie and, on the other hand, enhance the personalization options of this clothing item with a view to the final user.

The offer of more chromatic and pattern matching options for the necktie makes this solution more economical since, with a basic portion and a certain number of superimposing portions or vice versa, a high number of matching options can be obtained, without having to buy more traditional neckties and this convenience and economic advantage remain both in case of the attachments of the various portions being resolvable and non resolvable; by way of example, it is worth thinking of how, according to this invention, it is possible to make a necktie of various colors, therefore easier to suit to different types of clothing, also starting from simple pieces of one-color fabrics, which are often the only ones available on the market "on stock", without having to order huge amounts with long delivery terms.

Naturally the necktie can also be "made to measure" to enhance its final esthetic look even more, by superimposing several blades.

This invention is susceptible to changes and variants, all included in the concept of the invention. Moreover, all of the details can be replaced with technically equivalent elements.

The necktie accessory can fundamentally be said to lack any practical usefulness: substantially, the necktie does not solve any practical problem and its reason to exist lies in its value as an accessory meant to enhance, beautify and complement clothes as well as convey, depending on the case, different types of sensation to the wearer as well as to the viewers. As an accessory "in its pure state", the necktie undoubtedly has an aesthetic value, but furthermore, has a communicative value, and communicating originality, uniqueness and individuality as a rule means communicating characteristics that, generally speaking, are quite rare on the market: aesthetic uniqueness and individuality, in fact, are the main problem to solve in the field of clothing accessories, the main aim for the most part of manufacturers.

There is no doubt that a necktie consisting of separate superimposed blades can be easily distinguished from a necktie consisting of fake blades printed on the fabric or obtained with so-called jacquard structure and it is certain that the necktie obtained with these last two solutions would in no way have the same innovative and distinguishing character of the necktie obtained with single superimposed blades or in any case blades formed by separate and associated (for example sewn) portions of fabric (or other material), which, much more than a design may come close, though marginally, to the effect of the single superimposed blades.

The above mentioned distinctions can be undoubtedly made with absolute spontaneity regardless of whether the user stands just a few meters opposite us or is much further since, among other things, the above mentioned blades can move, at least partially, from the others and are therefore even more easily distinguishable as separate superimposed portions of fabric.

Therefore, since the neckties that are the subject of this application are characterized by special originality and novelty, they belong to those types of products that are initially identified for their rare characteristics, and for which the other characteristics that they feature, in this case: colors, designs, fabric types, etc., are in second place compared to the individualization mix—represented, for the neckties that are the subject of this application, by the simultaneous presence of factors: three or more separate and superimposed blades in view, multilayered knot, harmonic knot and harmony among the various blades, therefore harmony of the entire necktie, comparable to a traditional necktie.

The invention claimed is:

1. Multilayer necktie, necktie (1) of the type consisting of at least one portion (P) of fabric defined by three sections (2, 3, 4) held together without continuity solution defining: a first section (2) a blade of the mentioned necktie (1), standing, in use and in the most customary configuration, in sight, at least partly, on the user; a second section (3) the part knotted around the user's neck; a third section (4) a second blade, as wide as or wider than the first blade consisting of the first section (2), opposed to the same first blade (2) and standing, in use, in sight, at least partly, on a user; all three of the sections (2, 3, 4) being suitable, when in use, to make a knot (5) of the necktie, standing on the front part of the user's neck, characterized in that it has a second portion of fabric (6), superimposed on the mentioned first portion (P) of fabric in a position diametrically opposed to the largest blade (4) so that no portion of fabric is superimposed on the widest blade (4), joined or joinable to the same first portion, by means of relevant attachments (7), with this mentioned second portion (6) having an extension (S1) equal or almost equal to the extension (S") of the mentioned first and second section (2, 3) and width sizes (L6*a*, L6*b*) equal to, or preferably smaller than, the widths (L2, L3) of the mentioned first and second section (2, 3), so as to obtain a partial covering, widthwise and possibly lengthwise, of the same first and second sections (2, 3) of the mentioned first portion (P), so that the necktie is able to show at least partially, when knotted, three blades (6*a*,2,4) or only one blade (4), such as in an usual necktie.

2. Necktie, according to claim 1, characterized in that the mentioned second portion (6) has an extension (S) equal or almost equal to the extension (S') of the mentioned first section (2) of the mentioned first portion (P) and a width size (L6*a*) equal to, or preferably lower than, the width (L2) of the mentioned first section (2), so as to obtain a partial covering, widthwise and possibly also lengthwise, of the first section (2) of the mentioned first portion (P).

3. Necktie according to claim 1, characterized in that the mentioned second portion (6) has an extension (S2) equal or almost equal to the extension (S'") of the mentioned third section (4) of the mentioned first portion (P) and a width size (L6*c*) equal to, or preferably smaller than, the width (L4) of the mentioned third section (4), so as to obtain a partial covering, widthwise and possibly also lengthwise, of the same third section (4) of the mentioned portion (P).

4. Necktie according to claim 1, characterized in that the mentioned second portion (6) has an extension (S3) equal or almost equal to the extension (S"") of the mentioned second and third section (3, 4) of the mentioned first portion (P) and width sizes (L6*b*, L6*c*) equal to or preferably smaller than the width (L4) of the mentioned third section (4), so as to obtain a partial covering, widthwise and possibly also lengthwise, of the same third section (4) of the mentioned first portion (P).

5. Necktie according to claim 1, characterized in that the mentioned second portion (6) defines three sections (6*a*, 6*b*, 6*c*), similar to the mentioned first, second and third sections (2, 3, 4) of the mentioned first portion (P), dimensionally preferably smaller than the corresponding mentioned three sections of the mentioned first portion (P), so as to obtain a partial covering, widthwise, of the three mentioned sections (2, 3, 4) of the mentioned first portion (P).

6. Necktie according to claim 5, characterized in that the mentioned first, second and third sections (6*a*, 6*b*, 6*c*) of the mentioned second portion (6) have a length (Lu) shorter than the length (Lu') of the corresponding three sections (2, 3, 4) of the mentioned first portion (P).

7. Necktie according to claim 1, characterized in that it shows, once knotted in sight on the user in a way that, at least partly, three blades are visible, a knot (5) in which at least two different portions of fabric (St1, St2) can be seen.

8. Necktie according to claim 5, characterized in that it shows, once knotted in sight on the user, in a way that, at least partly, four blades are visible, a knot (5) in which at least two different portions of fabric (St1, St2) can be seen.

9. Necktie according to claim 1, characterized in that it shows, once knotted in sight on the user in a way that, at least partly, three blades are visible, a knot (5'") in which three different portions of fabric (St3, St4, St5) can be seen, since this is formed by a second portion (6) consisting of two portions (D, A), superimposed, with the necktie hanging and not knotted, on a portion (B) representing the mentioned first portion (P).

10. Necktie according to claim 1, characterized in that it shows, once knotted in sight on the user in a way that, at least partly, four blades are visible, a knot (5") in which four different portions of fabric (St6, St7, St8, St9) can be seen, since this is formed by a second portion (6) consisting of three portions (D, A, C), superimposed, with the necktie hanging and knot knotted, on a portion (B) representing the mentioned first portion (P).

11. Necktie according to claim 1, characterized in that it shows, once knotted in sight on the user, one single blade (4), like a traditional necktie, and a traditional knot (20) made of one single type of fabric.

12. Necktie according to claim 5, characterized in that it can show, once in sight on the user, only two blades (6*c*, 4).

13. Necktie according to claim 1, characterized in that, when looking at the necktie lying on a surface with the longitudinal axis running from the left to right hand-side of the viewer, the surfaces destined to be in sight of the left blades (Pv6*a*, Pv2) can be found to be upside-down compared to the surfaces destined to be in sight of the opposite blades (Pv4, and possibly Pv6*c*).

14. Necktie according to claim 1, characterized in that it has at least one portion (P) made in a reversible fashion therefore, showing, once knotted in a certain way around the user's neck, one single blade like a traditional necktie and a traditional knot (20) made of one single portion of fabric.

15. Necktie according to claim 1, characterized in that it has at least one of the joinable portions (B, A, C and possibly D) made in a reversible fashion.

16. Necktie according to claim 1, characterized in that the mentioned second portion (6) is joined to the mentioned first portion (P) by means of irreversible attachments(7) standing between the two mentioned portions (P, 6).

17. Necktie according to claim 1, characterized in that the mentioned second portion (6) is joined to the mentioned first portion (P) by means of reversible attachments (7) standing between the two mentioned portions (P, 6).

18. Necktie according to claim 1, characterized in that all or part of the various portions (D, A, C or 6*a*, 6*b*, 6*c*) making up the second portion (6) are joined together by means of irreversible attachments (7).

19. Necktie according to claim 1, characterized in that all or part of the various portions (D, A, C or 6*a*, 6*b*, 6*c*) making up the second portion (6) are joined together by means of reversible attachments (7).

20. Necktie according to claim 1, characterized in that all or part of the various portions (A, B or 2, 3, 4) making up the first portion (P) are joined together by means of irreversible attachments (7).

21. Necktie according to claim 1, characterized in that all or part of the various portions (A, B or 2, 3, 4) making up the first portion (P) are joined together by means of reversible attachments (7).

22. Necktie according to claim 1,characterized in that the mentioned reversible attachments (7) consist of a number of strips (9) of material, applied on relevant counter-faced surfaces (Ps, 6s) of the mentioned first and second portion (P, 6) and fitted with a relevant tear attachment and detachment surface (10), reciprocal.

23. Necktie according to claim 1, characterized in that the mentioned reversible attachments (7) are adjustable enabling the reciprocal settlement of the blades.

24. Necktie according to claim 1, characterized in that the mentioned first and second sections (2, 3 or A) of the first portion (P) and the first and second sections (6*a*, 6*b*or C) of the second portion (6) are joined together with irreversible attachments (7) and they are joined to the second and third sections (3, 4 or B) of the first portion (P) with reversible and adjustable attachments (7).

25. Necktie according to claim 1, characterized in that it has at least one section (2, 3) of the first portion (P) made in a reversible fashion.

26. Necktie according to claim 1, characterized in that it has only the wide blade, constituted by the third section (4) of the first portion (P), made in a reversible fashion.

27. Necktie according to claim 1, characterized in that it has at least the second portion of fabric (6) made in a reversible fashion.

* * * * *